US006748684B1

(12) United States Patent
Bar-Yona

(10) Patent No.: US 6,748,684 B1
(45) Date of Patent: Jun. 15, 2004

(54) DISPLAY UNITS

(75) Inventor: Itzchak Bar-Yona, Rosh Ha'Ayin (IL)

(73) Assignee: M. V. T. Multi Vision Technologies Ltd., Rosh Ha'Ayin (IL)

( * ) Notice: Subject to any disclaimer, the term of this patent is extended or adjusted under 35 U.S.C. 154(b) by 484 days.

(21) Appl. No.: 09/609,664

(22) Filed: Jul. 3, 2000

(30) Foreign Application Priority Data

Jul. 4, 1999 (IL) ..... 130782

(51) Int. Cl.[7] ..... G09F 11/00
(52) U.S. Cl. ..... 40/454; 40/437
(58) Field of Search ..... 345/110, 108, 345/905; 40/124.07, 414, 423, 454, 624, 738, 453, 489, 490, 491, 437

(56) References Cited

U.S. PATENT DOCUMENTS

| | | | | |
|---|---|---|---|---|
| 3,562,941 | A | 2/1971 | Boden | |
| 3,604,536 | A | 9/1971 | Dinnerstein | |
| 3,613,277 | A | 10/1971 | Rose et al. | |
| 3,660,919 | A | 5/1972 | Nagel | |
| 3,686,781 | A | 8/1972 | Calhoun, Jr. | |
| 3,742,631 | A | 7/1973 | Hasala | |
| 3,811,213 | A | 5/1974 | Eaves | |
| 4,034,555 | A | 7/1977 | Rosenthal | |
| 4,067,129 | A | 1/1978 | Abramson et al. | |
| 4,118,879 | A | * 10/1978 | Simon | 40/437 |
| 4,420,221 | A | 12/1983 | Sparks | |
| 4,454,670 | A | 6/1984 | Bachmann et al. | |
| 4,605,311 | A | 8/1986 | Loitz | |
| 4,870,768 | A | 10/1989 | Watt et al. | |
| 5,007,190 | A | 4/1991 | Shyu | |
| 5,035,929 | A | 7/1991 | Myers et al. | |
| 5,237,766 | A | 8/1993 | Mikolay | |
| 5,255,968 | A | 10/1993 | Craven | |

FOREIGN PATENT DOCUMENTS

| | | |
|---|---|---|
| CH | 131144 | 1/1929 |
| CH | 321586 | 5/1957 |
| CH | 337793 | 5/1959 |
| EP | 0 177 440 | 4/1986 |
| EP | 0 537 310 | 4/1993 |
| EP | 0 622 653 | 11/1994 |
| EP | 0 685 924 | 12/1995 |
| EP | 0 943 272 | 9/1999 |
| EP | 1 001 401 | 5/2000 |
| EP | 1 067 503 | 1/2001 |
| EP | 1 128 344 | 8/2001 |
| GB | 429042 | 5/1935 |
| GB | 2 295 043 | 5/1996 |
| GB | 2 308 005 | 6/1997 |
| JP | 2-54816 | 2/1990 |
| JP | 2-211437 | 8/1990 |
| JP | 7-334259 | 12/1995 |
| JP | 10-134235 | 5/1998 |
| JP | 11-66410 | 3/1999 |
| NL | 1013841 | 6/2001 |
| WO | WO 90/14782 | 12/1990 |
| WO | WO 95/30176 | 11/1995 |
| WO | WO 97/30436 | 8/1997 |

OTHER PUBLICATIONS

Patent Abstracts of Japan, JP 03–111887, May 13, 1991.

Patent Abstracts of Japan, JP 08–320659, Dec. 3, 1996.

(List continued on next page.)

*Primary Examiner*—Gary Hoge
(74) *Attorney, Agent, or Firm*—Oblon, Spivak, McClelland, Maier & Neustadt, P.C.

(57) ABSTRACT

The invention provides a display unit for displaying two or more consecutively changing images, the unit including a curved lenticular panel having front and rear faces; a displaceable, lightweight, image-carrying film spread out along the rear face; an electric drive coupled to the film for periodically displacing the film across the lenses of the panel, and guide means facilitating the smooth reciprocating movement of the film.

12 Claims, 6 Drawing Sheets

U.S. PATENT DOCUMENTS

| | | | |
|---|---|---|---|
| 5,270,636 | A | 12/1993 | Lafferty |
| 5,276,987 | A | 1/1994 | Honse |
| 5,416,997 | A | 5/1995 | Dyment et al. |
| 5,426,879 | A | 6/1995 | Hecker |
| 5,488,451 | A | 1/1996 | Goggins |
| 5,494,445 | A | 2/1996 | Sekiguchi et al. |
| 5,513,458 | A | 5/1996 | Dehli |
| 5,586,089 | A | 12/1996 | McGarvey |
| 5,647,151 | A | 7/1997 | Fantone et al. |
| 5,695,346 | A | 12/1997 | Sekiguchi et al. |
| 5,706,142 | A | 1/1998 | Lee |
| 5,720,123 | A | 2/1998 | Taylor |
| 5,724,758 | A | 3/1998 | Gulick, Jr. |
| 5,760,572 | A | 6/1998 | Takeda et al. |
| 6,026,215 | A | 2/2000 | Fantone et al. |
| 6,076,293 | A | 6/2000 | Bergeron |
| 6,078,424 | A | 6/2000 | Morton |
| 6,219,948 | B1 | 4/2001 | Bar-Yona |
| 6,226,906 | B1 | 5/2001 | Bar-Yona |
| 6,463,012 | B1 | 10/2002 | Bar-Yona |

* cited by examiner

DISPLAY UNITS

FIELD OF THE INVENTION

The present invention relates to display units, and particularly to display units that exhibit two or more consecutively changing images to be viewed by a viewer.

BACKGROUND OF THE INVENTION

Multiple image display devices of various kinds are known; among them are those comprising lenticular lenses in array with multi-dimensional lithographs moving in parallel planes. Such displays are described in U.S. Pat. No. 5,100,300 (Sediguchi) and U.S. Pat. No. 5,488,451 (Goggins), and also in U.S. patent application Ser. No. 09/248,318. The devices described in these documents relate basically to small-sized units, mainly for indoor use. These devices, however, prove to be inadequate for large-sized displays such as outdoor billboards.

The basic optical principles of these devices require an accurate positioning of the linear lenses in juxtaposition with the lithographic film. When large-sized displays are involved, such accuracy cannot be adequately achieved. Thermal changes and inconsistencies of printing processes are the main causes of such a drawback. U.S. Pat. 5,146,703 (Boden) and others tried to overcome this difficulty, but the fact that billboards based on the aforementioned optic principle are not in commercial use, suggests that an adequate device has not yet been devised.

Japanese Patent 0211437 (Kumagai) discloses a large-sized display having a cylindrical lens group, a framed body which supports an image carrier constituted of a transparent printing positive, and a light source at its rear face. The image processing of such a system imposes accurate positioning of the image carrier in close juxtaposition with the lenticular panel. Such conditions are achieved by the Kumagai device, which utilizes a rigid frame sliding along mechanical guide means disposed at a constant spacing from the lens group. Thus, an expensive and complicated solution is proposed, which also has its limitations regarding size and accuracy relationships between the lithographic prints and the lenses.

SUMMARY OF THE INVENTION

It is the object of the present invention to provide a display unit which ameliorates the above-described disadvantages of the prior art devices. It is a further object of the present invention to provide a low-cost display unit having disposable lithographic film of a large size disposed in close juxtaposition to the lenticular panel at an accurate distance from the lenses, for achieving a clear display of the images printed on the film, including changing images and stereoscopic animation.

It is a still further object of the present invention to provide a custom-made display unit consisting of only two fundamental parts: a lenticular panel and a lithographic film, without requiring a rear panel or frame, the unit being configured to be integrated into a custom-made platform of any shape or a light-box of any size, and which can also advantageously serve as a stand-alone product at points of sale, without connection to the electrical mains.

A yet further object of the invention is to provide a large-sized display unit for outdoor use that is capable of functioning in changing conditions of temperature and despite inaccuracies of the printing process.

In accordance with the present invention, there is therefore provided a display unit for displaying two or more consecutively changing images, said unit comprising a curved lenticular panel having front and rear faces; a displaceable, lightweight, image-carrying film spread out along said rear face; an electric drive coupled to said film for periodically displacing the film across the lenses of said panel, and guide means facilitating the smooth reciprocating movement of said film.

BRIEF DESCRIPTION OF THE DRAWINGS

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is a rear view of a display unit according to the present invention;

FIG. 2 is a front view of the display unit of FIG. 1;

FIG. 3 is an enlarged, cross-sectional view of a portion of the display unit along lines III—III of FIG. 1;

FIG. 4 is a perspective view of a large-sized display unit according to the present invention;

FIG. 5 is an enlarged, cross-sectional view of the display unit along lines V—V of FIG. 4;

FIGS. 6 and 7 illustrate lateral portions of a display unit furnished with means for controlling thermal expansion;

FIGS. 8 and 9 are schematic, optical representations of the present invention;

FIG. 10 is a block diagram illustrating a method of forming an image-carrying film utilizable with the display unit of the present invention;

FIG. 11 is a schematic representation illustrating considerations for forming an image-carrying film for large-sized display units;

FIGS. 12 and 13 illustrate different embodiments of the invention, and

Figure 14:
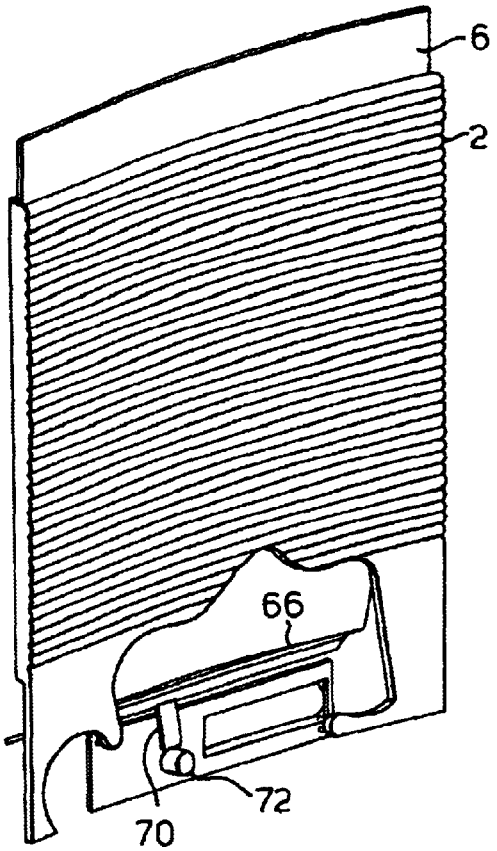
Figure 15:
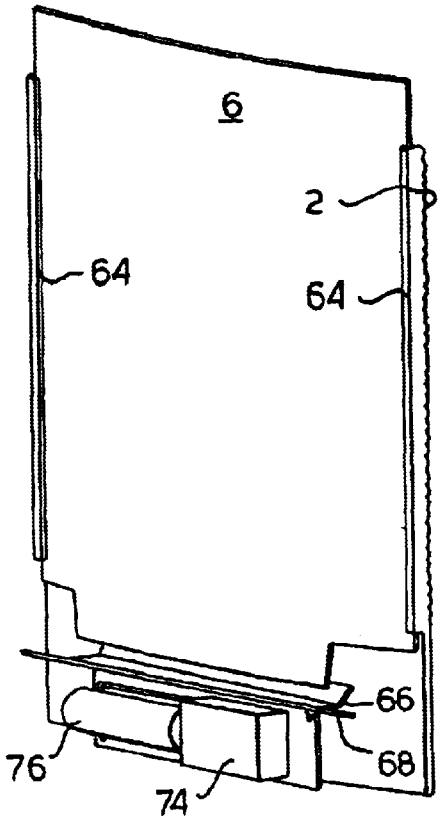

FIGS. 14 and 15 respectively depict the front and back views of a still further embodiment of the present invention.

DETAILED DESCRIPTION OF PREFERRED EMBODIMENTS

Figure 2:
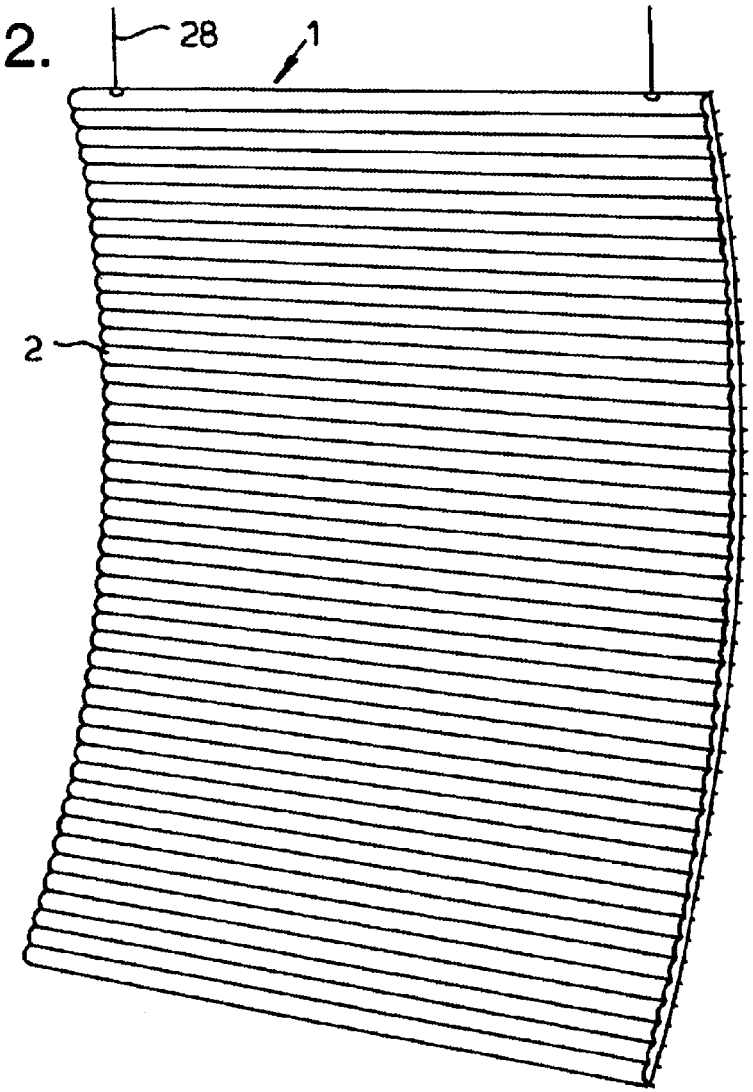
Figure 1:
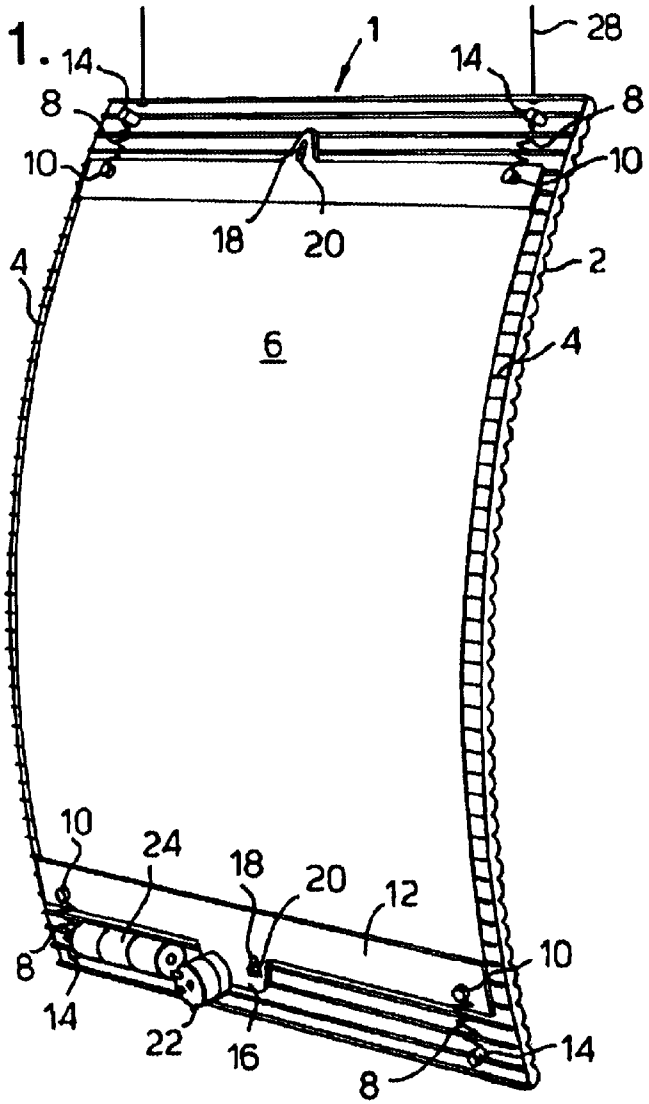

FIGS. 1 and 2 illustrate front and back views of a display unit for exhibiting two or more consecutively changing images. Seen is a lenticular panel 1 composed of cylindrical lenses 2 on its front side and ribs 4 on its back side. Panel 1 is slightly arched in a direction perpendicular to the axes of the lenses. A light-weight film 6 is spread out on the convex back side of panel 1 (FIG. 1) and is coupled thereto by means of, e.g., four springs 8 attached at one of their ends to pins 10 connecting rulers 12 across the upper and lower edges of film 6, and at their other ends to pins 14 anchored adjacent to the upper and lower corners of panel 1. Each of the upper and lower rulers 12 is provided with a tab 16 having a slot 18, through which penetrates a further pin 20 affixed to panel 1. The combination of slot 18 and pin 20 forms a guide means for film 6, assuring its accurate movement along panel 1.

Figure 3:
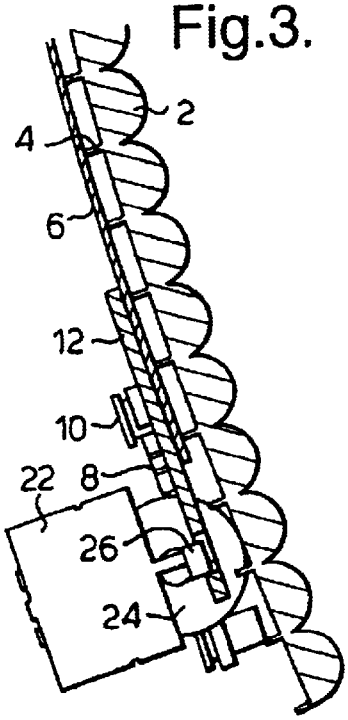

The movement of film 6 is effected by a high-efficiency electric motor 22 powered by batteries 24. The motor 22 rotates a cam 26 (FIG. 3), connecting its rotating movement to the linear movement of film 6. For illustration, on the front side of the panel 1 is displayed an image of the letter A (FIG. 2). The display unit can be hung from a ceiling by means of rods or wires 28, or otherwise, a custom-made unit can be incorporated into an existing display frame.

Figure 4:
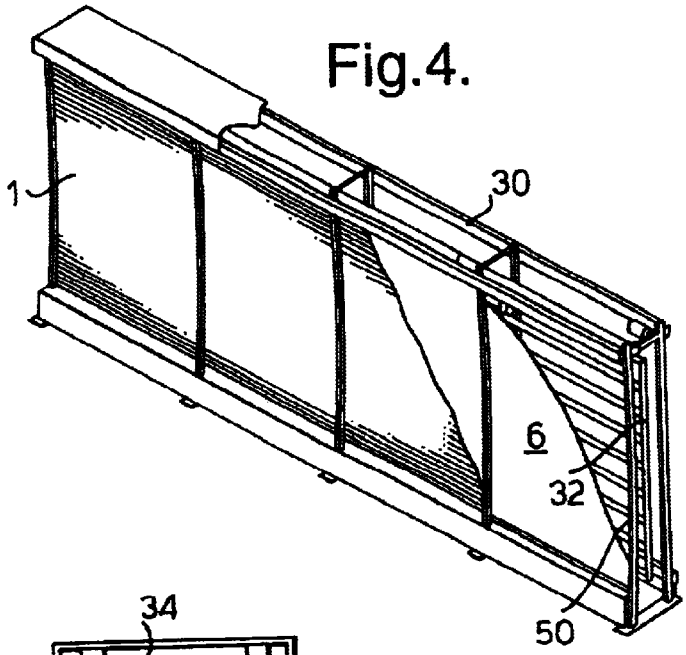
Figure 4:
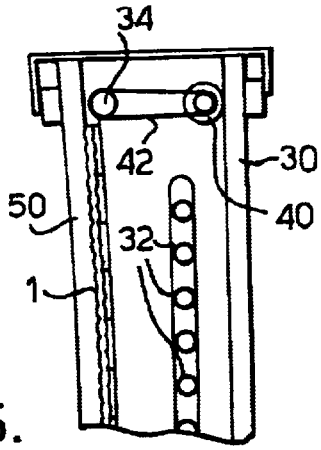
Figure 5:
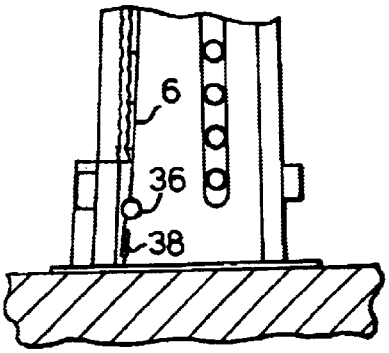

Referring to FIGS. 4 and 5, there is illustrated a display unit configured as a large billboard. Seen is a metallic frame 30 forming a support for a panel 1, and an array of lamps 32, e.g., fluorescent lamps, disposed behind panel 1 and film 6. The film 6 is coupled at its upper and lower edges to rollers 34, 36. The lower roller 36 is tensioned by means of a spring 38 connected to the base of frame 30. The upper roller 34 is coupled to a stepping motor 40 by means of, e.g., a belt 42, for transmitting a controlled, stepwise movement to the film.

Figure 6:
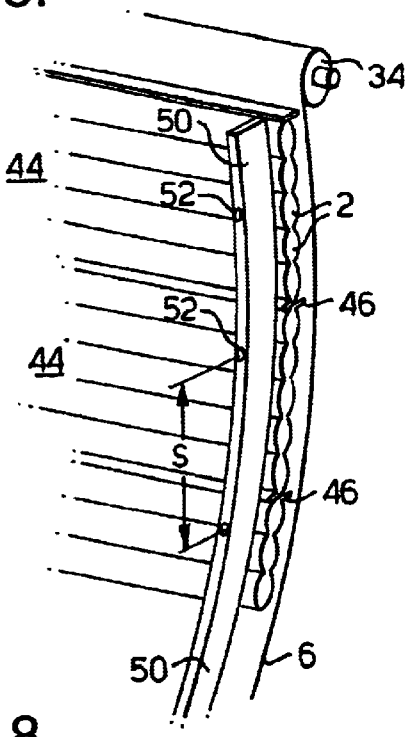
Figure 7:
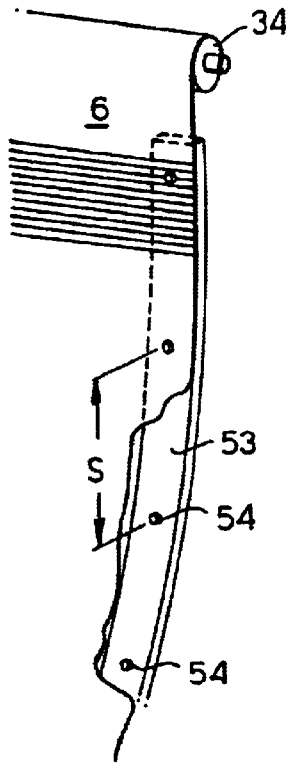
Figure 8:
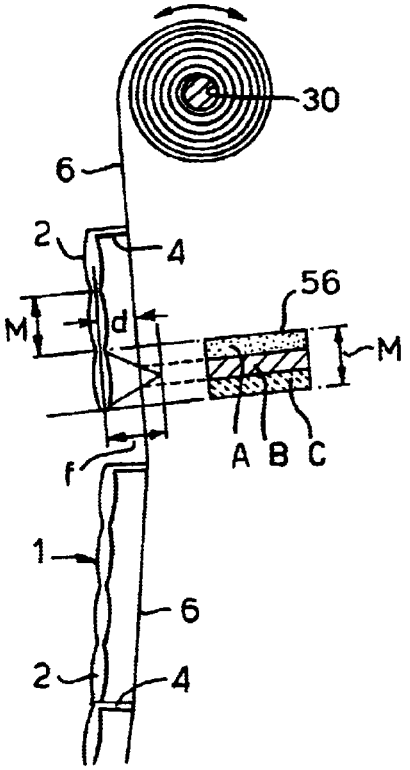
Figure 9:
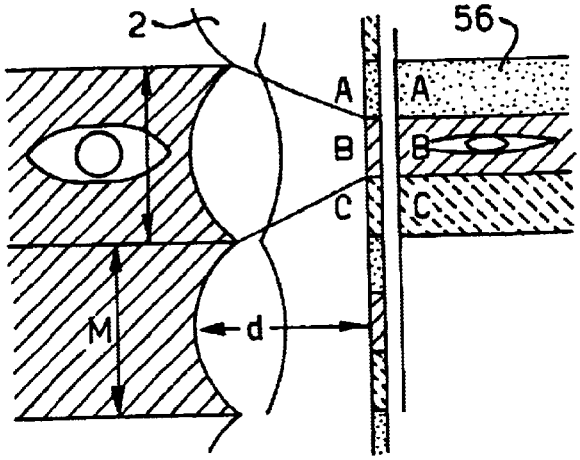

Referring to FIGS. 6 and 7, there are illustrated the front and back lateral portions of, e.g., the billboard unit of FIG. 4. In order to assure proper alignment between the film 6 and the lenses 2 in panel 1 under changing temperatures or, in other words, in order to assure the same thermal expansion of both the lenses 2 and the film 6—there are provided metal profiles having the same thermal expansion coefficient, as follows: Panel 1 is composed of a multiplicity of identical transparent panel modules 44, each having a rib 46 projecting towards the film 6. Modules 44 are affixed to the billboard frame profile 50 by rivets or screws 52 spaced equidistant from each other, for example at a distance S. Similarly, film 6 is provided with holes spaced apart at the same distance S facilitating its attachment to profiles 53 by means of pins 54. Several profiles may be attached to film 6 for large billboards. An enlarged portion of the panel 1 and film 6 of FIGS. 1 and 2 is illustrated in FIG. 8. Seen are the cylindrical lenses 2 spaced apart from film 6 by means of ribs 4 projecting between two adjacent cylindrical lenses. The lithographic printing on the film is composed of an array of strips A, B and C, constituting frames 56 having an overall modular dimension M, which is substantially equal to the width of a single lens and the images produced on the lens by the three strips A, B and C. The distance d between the film 6 and a lens 2 will be f×⅔, wherein f is the focal length of the lens 2. The relationship between the focal length f of the lenses 2 and the frames 56 is further explained with reference to FIG. 9. Strips A, B and C carry information in a compressed form. Whenever, e.g., strip B is positioned behind a lens 2, the compressed information is magnified to its non-compressed size.

Figure 10:
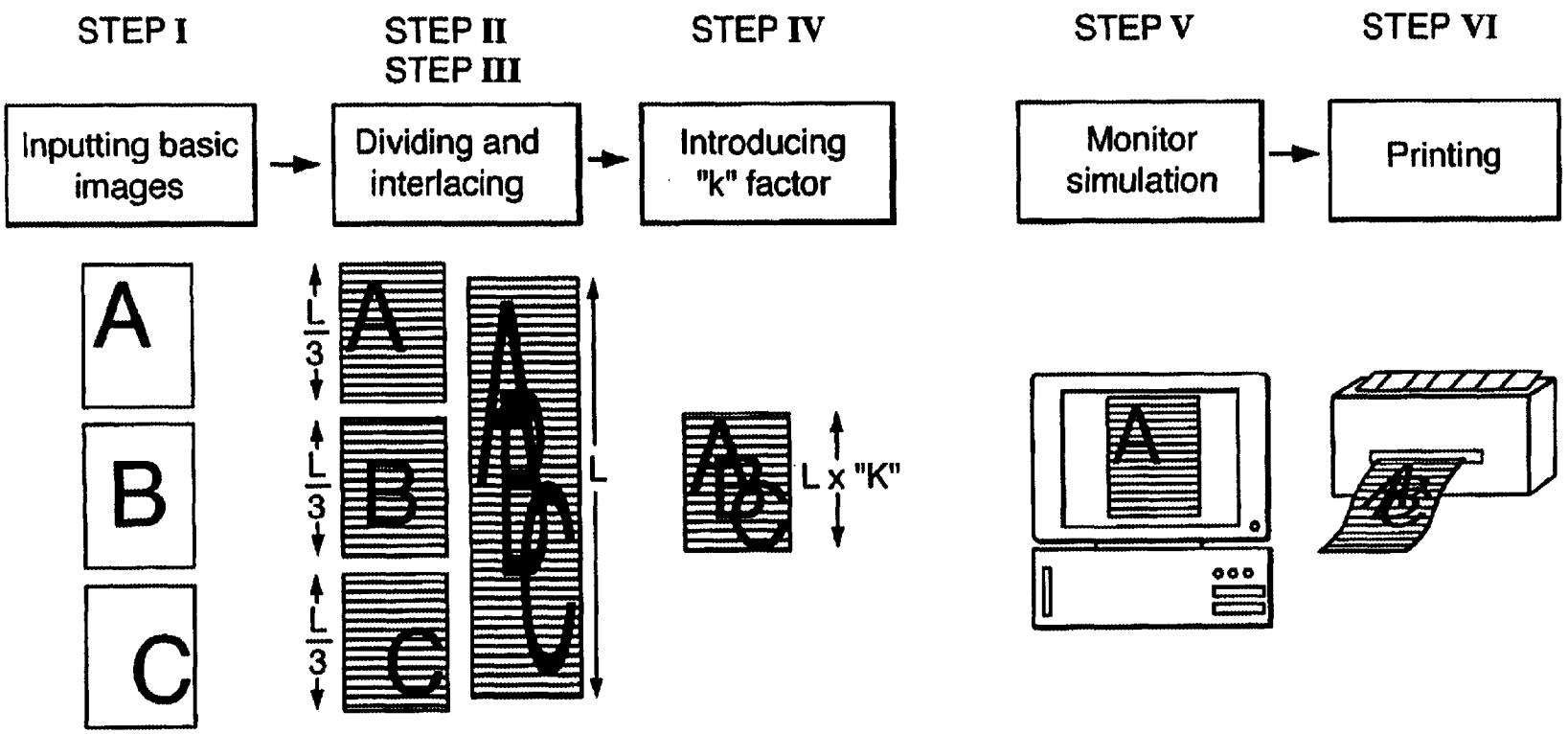
Figure 11:
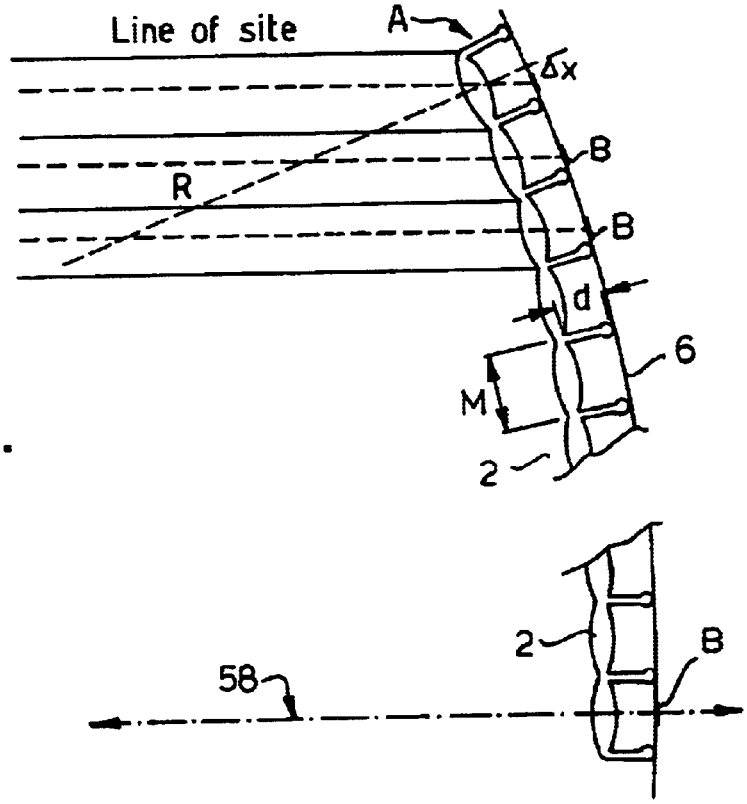

The compression of the images can be achieved by the process shown in FIGS. 10 and 11. 1n the first step 1, three basic images A, B and C are entered into a computer's memory. Each image has a vertical dimension of L/3. In the next step II, the images are stripped into N independent frames, wherein N also constitutes the number of lenses in the lenticular panel 1. In step III, the individual strips are interlaced to form a file having the dimension L=A+B+C. The file is then compressed (step IV) by a factor K calculated according to the number of the stripped basic images N, the size of the lenses M, the distance d of the film 6 from the lenses 2, and the radii of curvature R of the lenses. In order to calculate such a factor K of a planar lenticular panel, it is sufficient to divide by the number of images, i.e., $$K = \frac{1}{3},$$

namely, the film should be compressed by 33⅓%.

A curved or arched panel, however, requires further compression. Strip B (FIG. 11), which is located at the lower edge of a lens 2 at the upper portion of the panel 1, must be shifted towards the axis of curvature 58 of the panel near its central portion. Each of the strips B should accordingly be shifted so that the line of sight which is parallel to the axis 58 of the panel will meet the strip B in each lens of the panel. The amount of shifting Δx is calculated as follows:

$$\Delta x = \frac{M_N d}{2R}$$

where $M_N$ is the vertical dimension of the lenticular panel compression factor=

$$K = \frac{M_N - \Delta x}{3M_N};$$

and for three images, $$K = \frac{1}{3}\left(1 - \frac{d}{2R}\right);$$

for P images, $$K = \frac{1}{P}\left(1 - \frac{d}{2R}\right).$$

After compression (FIG. 10), the operator may wish to view the results of the compression for approval or correction, and that is effected in step V, on a suitable monitor. The interlaced and compressed lithography can now be printed on a film (step VI).

Three-dimensional images on film 6 can also be utilized with the display units according to the present invention. Such three-dimensional films can be produced in accordance with the description in, e.g., U.S. Pat. No. 5,436,738, or others.

Figure 12:
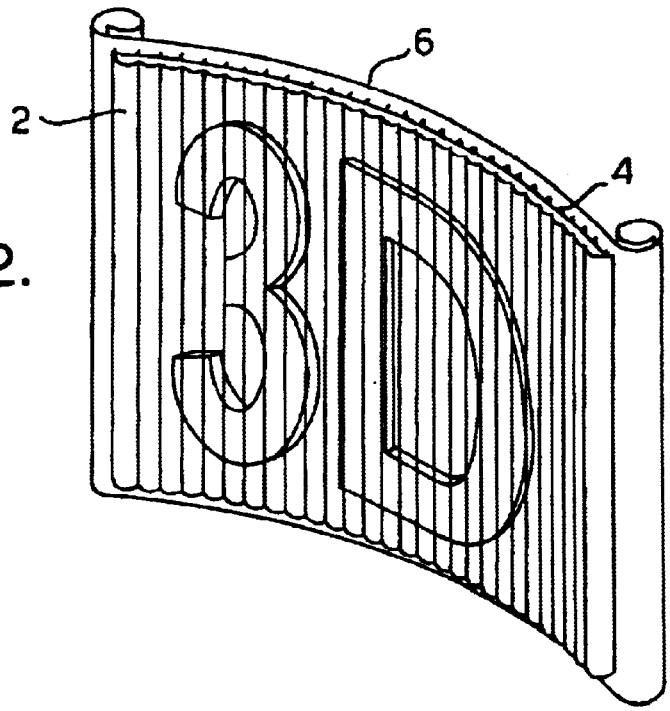

In FIG. 12 there is illustrated a modification of the display unit of FIGS. 1 to 5, in which three-dimensional images can be displayed. The display unit includes an arched panel 1 having vertically extending linear lenses 2 supporting a film 6 stretched along the tips of ribs 4. The film 6 is rolled along its vertically extending lateral edges, to be moved in controlled steps in a horizontal direction.

Figure 13:
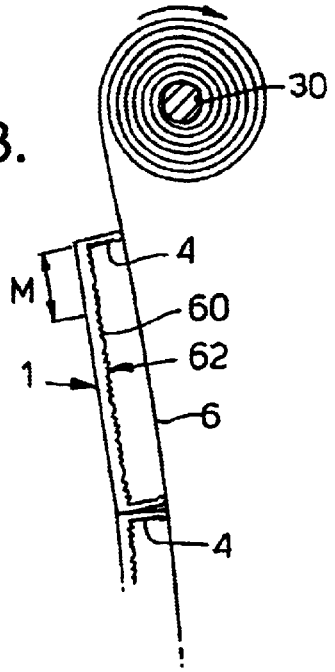

A further possible modification of the invention is presented in FIG. 13 Instead of the panel 1 having cylindrical lenses 2, the invention can be embodied in a panel having an array of microprisms 60 which are embossed on the rear face 62 of the panel. Each array of microprisms 60 represents a linear lens of a modular dimension M. The dimensions of the panel, calculated according to Fresnel principles, provide a thin, light-weight, flat screen. The film 6 is spaced apart from the rear side of the panel by means of ribs 4, to be slid there across by means of the roller 34 and roller 36 (not shown), similar to the movement of the film 6 according to FIGS. 4 and 5.

Turning now to FIGS. 14 and 15, there is illustrated a still further embodiment of the invention in which the curvature of the panel is along the axis of the cylindrical lenses 2. The light-weight film 6 is retained across the rear face of the panel 1 by means of two laterally extending guides 64, which may be constituted by bent portions integrally formed as lateral channels with panel 1 as shown in FIG. 15. The film 6 is freely supported at its bottom edge on a shelf 66 movable about an axis 68. Shelf 66 is provided, at its lower surface, with a member 70 suitably configured to be coupled at its free end to a cam 72, rotatable by a drive 74 powered from a battery 76.

It will be evident to those skilled in the art that the invention is not limited to the details of the foregoing illustrated embodiments and that the present invention may be embodied in other specific forms without departing from the spirit or essential attributes thereof The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A display unit for displaying two or more consecutively changing images, said unit comprising:

a curved lenticular panel having front and rear faces;

a displaceable, lightweight, image-carrying film spread out along said rear face;

an electric drive coupled to said film for periodically displacing the film across lenses of said panel, and guide means facilitating smooth reciprocating movement of said film.

2. The display unit as claimed in claim 1, wherein said panel comprises an array of lenses at its front face and ribs projecting from its rear face.

3. The display unit as claimed in claim 2, wherein said ribs project from a line between two adjacent linear lenses.

4. The display unit as claimed in claim 1, wherein said panel is composed of microprisms having changing slopes configured according to Fresnel's law.

5. The display unit as claimed in claim 1, wherein the lenses in said lenticular panel have a width $$d = f\left(1 - \frac{1}{n}\right)$$

wherein:

f is a focal length of the lens, and n is a number of changing images.

6. The display unit as claimed in claim 2, wherein said film is spread out along free edges of said ribs by means of springs.

7. The display unit as claimed in claim 1, wherein said film is spread out along the rear face of said panel by means of said guide means.

8. The display unit as claimed in claim 1, wherein said guide means are constituted by pins projecting from said panel and matching slots formed in said film.

9. The display unit as claimed in claim 1, wherein said guide means are constituted by channels holding said film and restricting its lateral movement.

10. The display unit as claimed in claim 1, further comprising means assuring substantially equal thermal expansion of said panel and said film.

11. The display unit as claimed in claim 10, wherein said means assuring substantially equal thermal expansion includes a metal profile attached at equal spacings to both said panel and said film.

12. The display unit as claimed in claim 1, wherein said drive comprises at least one roller on which a portion of said film is wound and an electric motor coupled to said roller.

* * * * *